US009327925B2

(12) United States Patent
Uohashi

(10) Patent No.: US 9,327,925 B2
(45) Date of Patent: May 3, 2016

(54) IMAGE FORMING APPARATUS AND PAPER FEED CASSETTE

(71) Applicant: KYOCERA Document Solutions Inc., Osaka (JP)

(72) Inventor: Yuki Uohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/539,168

(22) Filed: Nov. 12, 2014

(65) Prior Publication Data

US 2015/0130129 A1 May 14, 2015

(30) Foreign Application Priority Data

Nov. 14, 2013 (JP) ..... 2013-235598

(51) Int. Cl.
*B65H 1/00* (2006.01)
*B65H 1/26* (2006.01)

(52) U.S. Cl.
CPC ..... *B65H 1/266* (2013.01); *B65H 2511/10* (2013.01); *B65H 2511/212* (2013.01); *B65H 2701/113* (2013.01)

(58) Field of Classification Search
CPC ..... B65H 1/04; B65H 1/26; B65H 1/266; B65H 1/027; B65H 1/08; B65H 7/02; B65H 2405/31; B65H 2405/114; B65H 2701/113; B65H 2511/10; B65H 2511/12; B65H 2511/212
See application file for complete search history.

(56) References Cited

U.S. PATENT DOCUMENTS

2004/0047663 A1* 3/2004 Yano ..... B65H 1/266 399/389
2012/0299237 A1* 11/2012 Mizuguchi ..... B65H 1/266 271/145
2013/0134658 A1* 5/2013 Nagai ..... B65H 1/00 271/171
2014/0077444 A1* 3/2014 Fujii ..... B65H 1/266 271/162
2015/0084276 A1* 3/2015 Matsuno ..... B65H 1/266 271/265.01

FOREIGN PATENT DOCUMENTS

JP 2009-073664 A 4/2009

* cited by examiner

*Primary Examiner* — Prasad Gokhale
(74) *Attorney, Agent, or Firm* — Studebaker & Brackett PC

(57) ABSTRACT

An image forming apparatus includes a body, a paper feed cassette, a rotary operating member, an engaging portion, engaged portions, and a size detection switch. The rotational operating member is rotatable. The engaging portion engages the rotary operating member with the paper feed cassette. Any one of the engaged portions is engaged by the engaging portion. The size detection switch is used to detect the size of a recording medium stored in the paper feed cassette. The rotational operating member includes a pressure portion that activates the size detection switch. The rotational force in the first direction necessary for causing the engagement to be released is greater than the rotational force in the second direction necessary for causing the engagement to be released.

15 Claims, 8 Drawing Sheets

IMAGE FORMING APPARATUS AND PAPER FEED CASSETTE

INCORPORATION BY REFERENCE

The present application claims priority under 34 U.S.C. §119 to Japanese Patent Application No. 2013-235598, filed Nov. 14, 2013. The contents of this application are incorporated herein by reference in their entirety.

BACKGROUND

The present disclosure relates to an image forming apparatus and a paper feed cassette.

Some image forming apparatuses, such as copiers, are provided with a paper feed cassette for storing a plurality of recording mediums (such as sheets of copy paper), detachably attached to an apparatus body of the image forming apparatus. With respect to such an image forming apparatus, a technology is suggested for automatically detecting the size of recording mediums stored in a paper feed cassette upon attachment of the paper feed cassette to the apparatus body of the image forming apparatus.

Some image forming apparatuses include a paper feed cassette that is provided with a size detection dial, and a user rotates the size detection dial to match a size mark (such as A4, A3, and B5) presented on the paper feed cassette to the size of the recording mediums stored in the paper feed cassette.

The size detection dial is provided with a plurality of notches as engaged portions on its circumference at predetermined angular intervals relative to the rotation axis. The paper feed cassette is provided with a projection as an engaging portion. Each of the engaged portions can be engaged with and disengaged from the engaging portion.

With one of the engaged portions being engaged by the engaging portion, the size detection dial is engaged with the paper feed cassette at the predetermined angular intervals. When the size detection dial in engagement with the paper feed cassette receives a rotational force equal to or greater than a predetermined value, the engaged portion comes to be disengaged from the engaging portion, which allows the size detection dial to rotate.

The size detection dial is provided with a plurality of pressure portions on its circumference at predetermined angular intervals relative to the rotation axis. When a user attaches the paper feed cassette to the image forming apparatus, at least one of a plurality of size detection switches is activated by being depressed by at least one of the pressure portions of the size detection dial, or all of the size detection switches are left unactivated by not being depressed by any pressure portion of the size detection dial. The controller of the image forming apparatus identifies the size of the recording mediums stored in the paper feed cassette based on the ON and OFF combination of the plurality of size detection switches.

SUMMARY

According to a first aspect of the present disclosure, an image forming apparatus includes an apparatus body, a paper feed cassette, a rotary operating member, an engaging portion, a plurality of engaged portion, and a size detection switch. The paper feed cassette is attachable to and detachable from the apparatus body. The rotational operating member is rotatably mounted to the paper feed cassette. The engaging portion is provided in the paper feed cassette and engages the rotary operating member with the paper feed cassette at predetermined angular intervals. The engaged portions are provided in the rotary operating member, and any one of the engaged portions is engaged by the engaging portion. The size detection switch is provided in the apparatus body and for detecting a size of a recording medium stored in the paper feed cassette. The rotational operating member includes a pressure portion that activates the size detection switch. Each of the engaged portions releases engagement with the engaging portion in response to a rotational force equal to or greater than a predetermined value applied to the rotary operating member. A rotational force in a first direction necessary for causing the engagement to be released is greater than a rotational force in a second direction necessary for causing the engagement to be released. The second direction is reverse of the first direction.

According to a second aspect of the present disclosure, a paper feed cassette is attachable to and detachable from an apparatus body of an image forming apparatus. The paper feed cassette includes a rotary operating member and an engaging portion. The rotational operating member is rotatably mounted. The engaging portion engages the rotary operating member at predetermined angular intervals. The rotary operating member includes a plurality of engaged portions and a pressure portion. Any one of the engaged portions is engaged by the engaging portion. The pressure portion activates a size detection switch that is provided in the apparatus body of the image forming apparatus and that is for detecting a size of a recording medium stored in the paper feed cassette. Each of the engaged portion releases engagement with the engaging portion in response to a rotational force equal to or greater than a predetermined value applied to the rotary operating member. A rotational force in a first direction necessary for causing the engagement to be released is greater than a rotational force in a second direction necessary for causing the engagement to be released. The second direction is reverse of the first direction.

DETAILED DESCRIPTION

Figure 1:
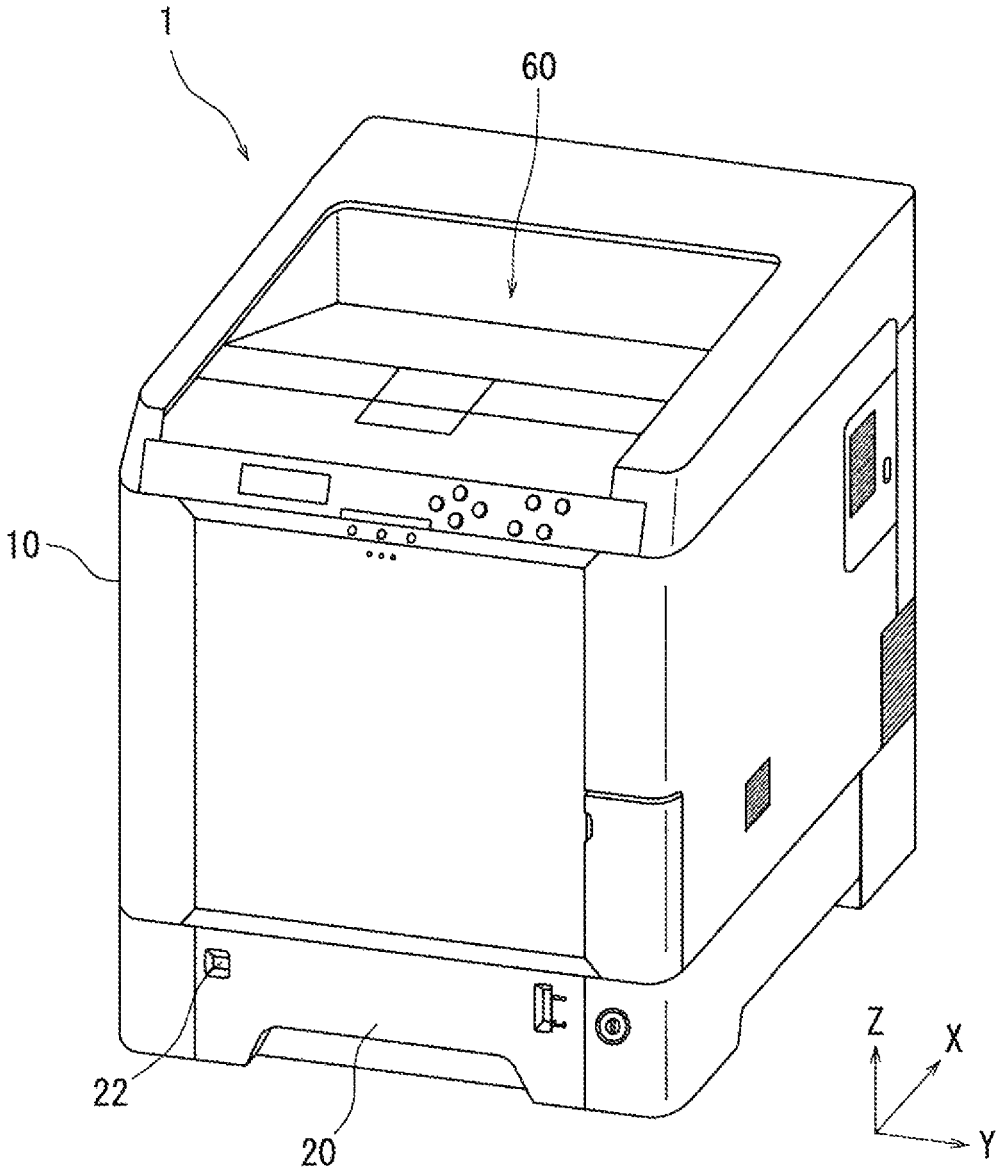
FIG. 1 is a perspective view showing an image forming apparatus according to an embodiment of the present disclosure.

The following describes embodiments with reference to the accompanying drawings. FIG. 1 is a perspective view of an image forming apparatus 1 according to an embodiment of the present disclosure.

The image forming apparatus 1 shown in FIG. 1 is a printer and includes an apparatus body 10 and a paper feed cassette 20. The apparatus body 10 is provided with a paper discharge section 60 on its upper face. The paper discharge section 60 is for receiving a plurality of recording mediums (such as a plurality of sheets of paper (not illustrated)) discharged after an image is formed thereon.

The paper feed cassette 20 stores a plurality of sheets of paper in a stack. The paper feed cassette 20 is provided with an observing window 22 in its front face. The observing window 22 presents a size mark corresponding to the size of paper stored in the paper feed cassette 20. The paper feed cassette 20 is attachable to and detachable from the apparatus body 10 in a direction along the X axis.

Figure 2:
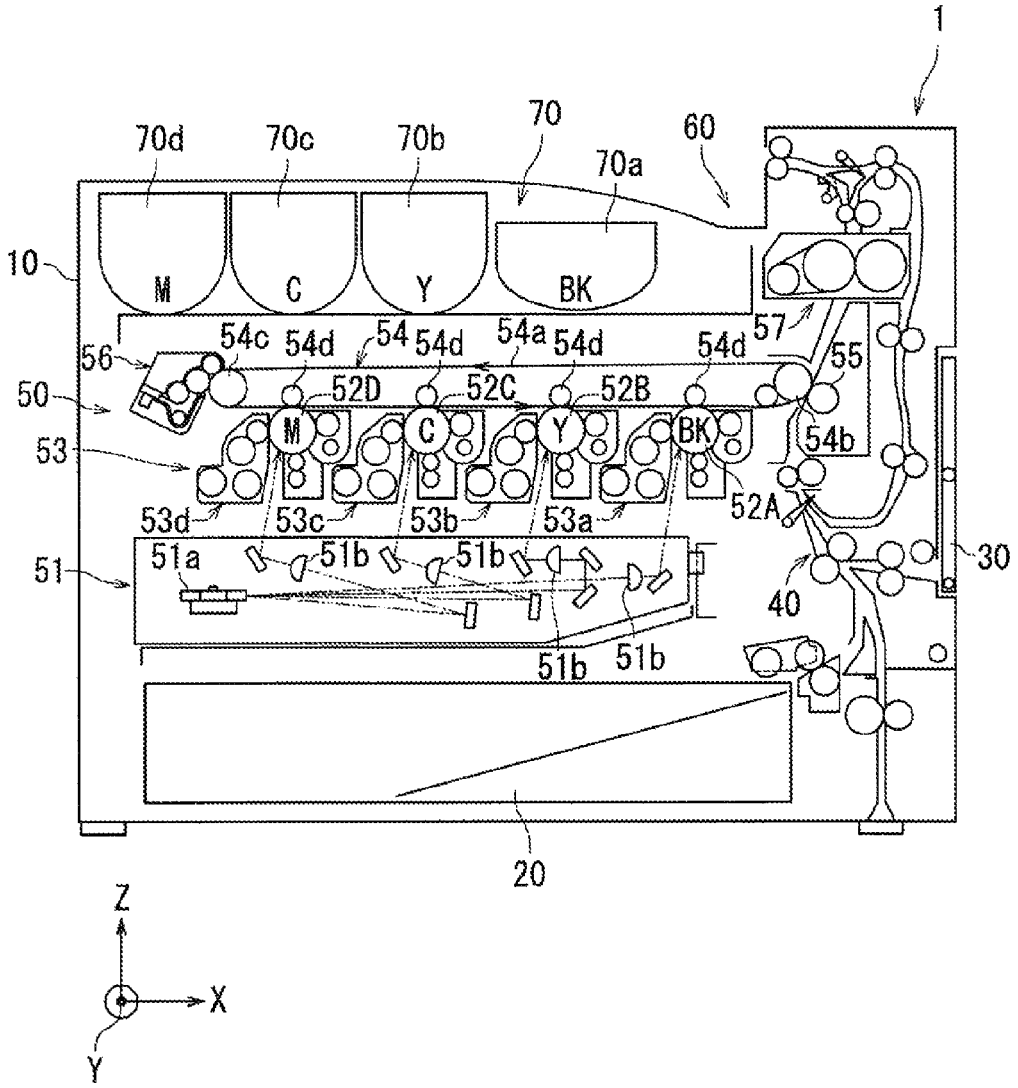
FIG. 2 is a cross sectional view schematically showing the structure of the image forming apparatus shown in FIG. 1.

FIG. 2 is a schematic cross sectional view showing the structure of the image forming apparatus 1. As shown in FIG. 2, the image forming apparatus 1 further includes a paper feed tray 30, a conveyance section 40, an image forming section 50, and a toner cartridge accommodating section 70.

The paper feed tray 30 is swingably mounted to the rear face of the apparatus body 10 and swings between a closed position in which the paper feed tray 30 stands substantially vertically and an open position in which the paper feed tray 30 projects obliquely upward from the rear face of the apparatus body 10.

The conveyance section 40 includes a plurality of rollers and guide members and picks up paper stored in the paper feed cassette 20 one sheet at a time to convey the paper to the image forming section 50.

The image forming section 50 includes a laser scanning unit 51, photosensitive drums 52A-52D, a developer unit 53, an intermediate transfer belt unit 54, a secondary transfer roller 55, a cleaning unit 56, and a fixing unit 57.

The laser scanning unit 51 includes a light beam generator (not illustrated) that emits a light beam according to image data, a polygon mirror 51*a* that reflects the light beam emitted from the light beam generator, and a plurality of fθ lenses 51*b*. Each fθ lens 51*b* directs the light beam reflected by the polygon mirror 51*a* to cause an image to be formed on the circumferential surface of a corresponding one of the photosensitive drums 52A-52D.

The photosensitive drums 52A-52D are spaced apart in a front-rear direction of the apparatus body 10. The front-rear direction is a direction along the X axis. The photosensitive drum 52A is for forming a black image, the photosensitive drum 52B is for yellow, the photosensitive drum 52C is for cyan, and the photosensitive drum 52D is for magenta.

Each of the photosensitive drums 52A-52D is provided with a charger, a static eliminator, and a cleaner. On the charged circumferential surface of each of the photosensitive drums 52A-52D, the laser scanning unit 51 forms an electrostatic latent image conforming to the image data.

The developer unit 53 includes developing devices 53*a*-53*d*. The developing device 53*a* supplies black toner to the photosensitive drum 52A, thereby developing the electrostatic latent image on the circumferential surface of the photosensitive drum 52A. The developing device 53*b* supplies yellow toner to the photosensitive drum 52B, thereby developing the electrostatic latent image on the circumferential surface of the photosensitive drum 52B. The developing device 53*c* supplies cyan toner to the photosensitive drum 52C, thereby developing the electrostatic latent image on the circumferential surface of the photosensitive drum 52C. The developing device 53*d* supplies magenta toner to the photosensitive drum 52D, thereby developing the electrostatic latent image on the circumferential surface of the photosensitive drum 52D.

The intermediate transfer belt unit 54 includes an intermediate transfer belt 54*a*, a drive roller 54*b*, a tension roller 54*c*, and four primary transfer rollers 54*d*. The intermediate transfer belt 54*a* is an endless belt stretched between the drive roller 54*b* and the tension roller 54*c*.

The four primary transfer rollers 54*d* are opposed to the respective photosensitive drums 52A-52D. The four primary transfer rollers 54*d* rotate by following the intermediate transfer belt 54*a*. As a result, the toner images formed on the photosensitive drums 52A-52D are transferred to the intermediate transfer belt 54*a* so as to be superimposed to form a color image.

The secondary transfer roller 55 is opposed to the drive roller 54*b*, and paper is passed between secondary transfer roller 55 and the intermediate transfer belt 54*a* to transfer the color image from the intermediate transfer belt 54*a* to the paper.

The cleaning unit 56 removes residual toner from the intermediate transfer belt 54*a* with, for example, a blade and discharges the removed toner into a waste toner container (not illustrated).

The fixing unit 57 includes a pair of rollers and applies heat and pressure to the paper passing between the rollers. As a result, the color image transferred to the paper is fixed.

The paper to which the color image is fixed is conveyed upward by the conveyance section 40 and discharged to the paper discharge section 60.

The toner cartridge accommodating section 70 accommodates a black toner cartridge 70*a*, a yellow toner cartridge 70*b*, a cyan toner cartridge 70*c*, and a magenta toner cartridge 70*d* all of which are detachable therefrom. The toner cartridges 70*a*-70*d* supply toner of the respective colors to the developing devices 53*a*-53*d*.

In response to a print start instruction input to the image forming apparatus 1, the drive roller 54*b* is driven to rotate the intermediate transfer belt 54*a*. In color printing, the laser scanning unit 51 emits a light beam to each of the photosensitive drums 52A-52D according to the image data so as to form an electrostatic latent image on a corresponding one of the photosensitive drums 52A-52D.

Next, toner is supplied from the developing devices 53*a*-53*d* respectively to the photosensitive drums 52A-52A thereby to develop each electrostatic latent image into a toner image. Then, the toner images of the four colors are sequentially transferred to and superimposed on the intermediate transfer belt 54*a* via the four primary transfer rollers 54*d*. This forms the color image on the intermediate transfer belt 54*a*. The color image thus formed is transferred to paper via the secondary transfer roller 55 and then fixed to the paper through application of heat and pressure by the fixing unit 57. Finally, the paper on which the color image is printed is discharged to the paper discharge section 60.

The image forming apparatus 1 further includes a mechanism for automatic detection of the size of paper stored in the paper feed cassette 20. The mechanism is described below with reference to FIGS. 3-6.

Figure 3:
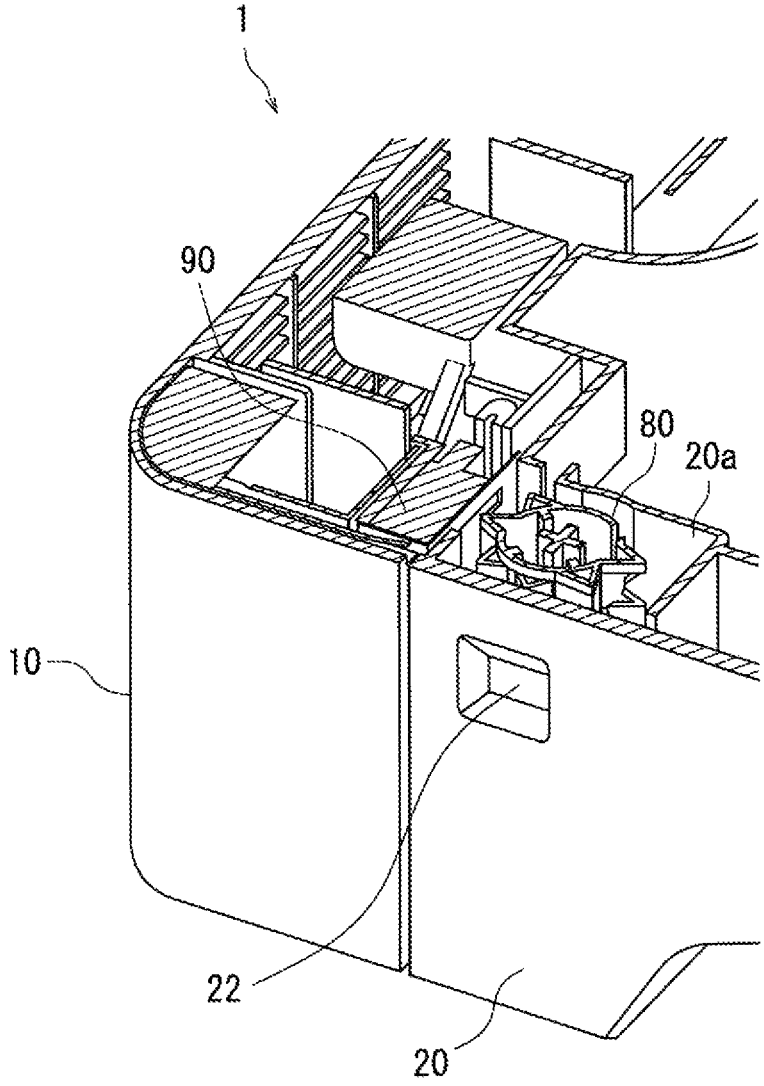
FIG. 3 is a perspective view showing part of the internal structure of the image forming apparatus shown in FIG. 1.
Figure 4:
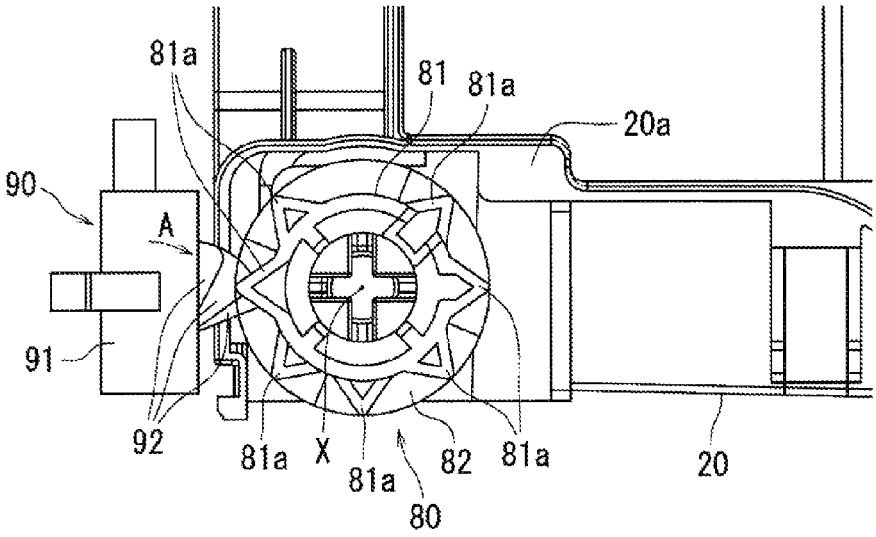
FIG. 4 is a plan view showing size detection switches and part of a paper feed cassette both shown in FIG. 1.
Figure 5:
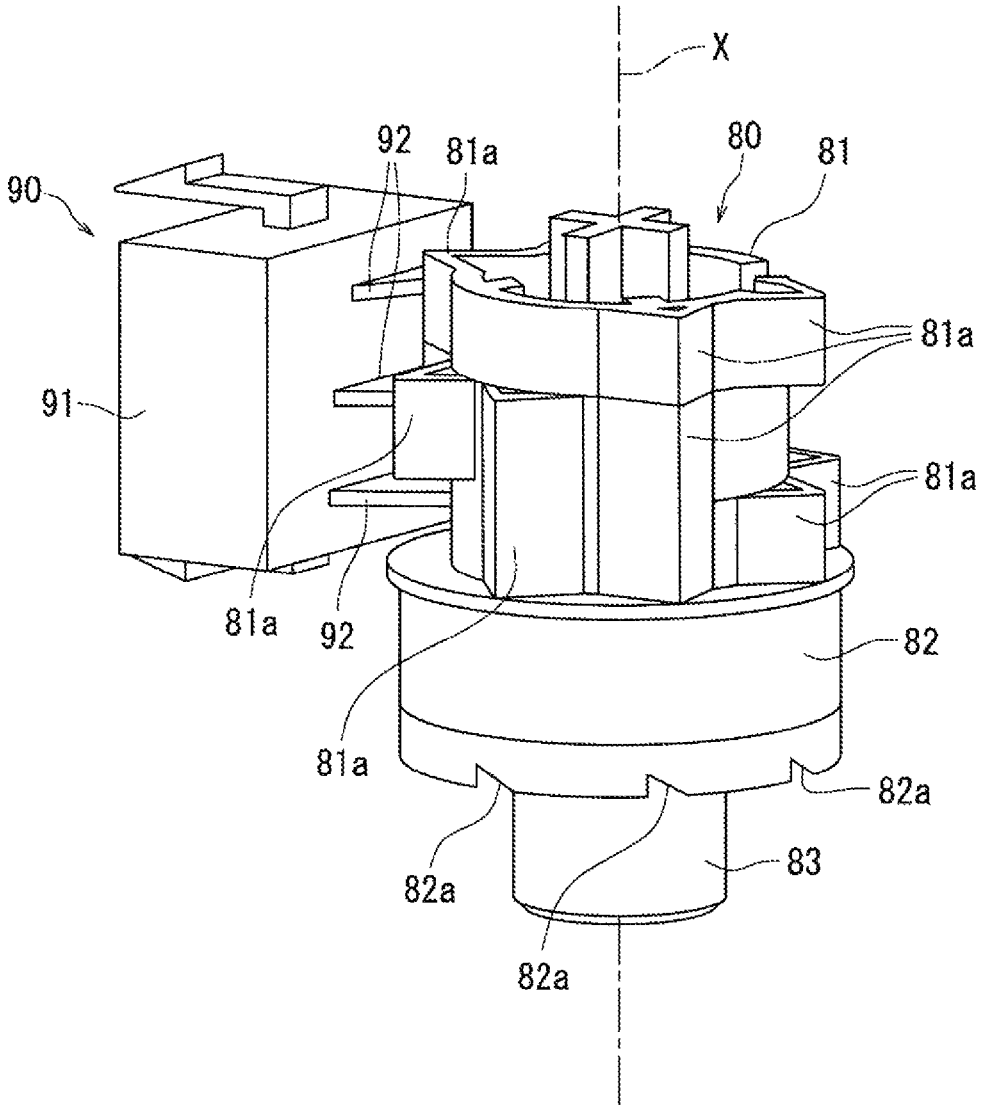
FIG. 5 is a perspective view showing a size detection dial and the size detection switches provided in the image forming apparatus shown in FIG. 1.

FIG. 3 is a perspective view showing part of the internal structure of the image forming apparatus 1 shown in FIG. 1. FIG. 4 is a plan view showing a size detector 90 and part of the paper feed cassette 20. FIG. 5 is a perspective view showing a size detection dial 80 and the size detector 90.

As shown in FIGS. 3 and 4, the paper feed cassette 20 has a dial accommodating section 20*a* located at a side portion along the front face of the paper feed cassette 20. The dial accommodating section 20*a* accommodates the size detection dial 80 serving as a rotary operating member. The size detection dial 80 is made from synthetic resin, such as acrylonitrile-butadiene-styrene (ABS), and includes a dial portion 81, a mount 82, and a sliding portion 83 as shown in FIG. 5.

The size detection dial 80 is mounted to the bottom of the dial accommodating section 20*a* via the sliding portion 83 so as to be rotatable on the rotation axis X. The size detection dial 80 is slidable relative to the paper feed cassette 20 in a direction along the rotation axis X and downwardly urged by a spring (not illustrated).

The dial portion 81 is tubular and provided with a plurality of pressure portions 81*a* on the circumference of the dial portion 81. The pressure portions 81*a* are displaced with respect to one another in a circumferential direction or a vertical direction of the dial portion 81. The pressure portions 81*a* each have a triangular shape in a plan view and project radially outwardly from the dial portion 81.

The mount 82 is a cylindrical tube that is closed at the upper face to which the dial portion 81 is secured. Although not illustrated, the mount 82 is provided with size marks (such as A3, A4, and B5) each indicating a size of paper. The size marks are disposed at circumferentially spaced intervals on the outer circumference of the mount 82. As shown in FIG. 5, the mount 82 has a plurality of engaged portions 82*a* along the lower edge thereof at circumferentially spaced intervals. Each of the engaged portions 82*a* is a notch. The engaged portions 82*a* will be described later in detail.

The size detector 90 includes a detector body 91 and a plurality of size detection switches 92. The size detection switches 92 are used to detect the size of paper stored in the paper feed cassette 20. The size detection switches 92 are vertically spaced apart from one another and disposed at positions corresponding to the pressure portions 81*a*. Each of the size detection switches 92 is retractable into and projectable from the detector body 91. In addition, each of the size detection switches 92 is urged by a spring (not illustrated) in a direction of an arrow A shown in FIG. 4 and thus projects from a side surface of the detector body 91. When depressed into the detector body 91 by a predetermined amount, each of the size detection switches 92 is activated.

Figure 6:
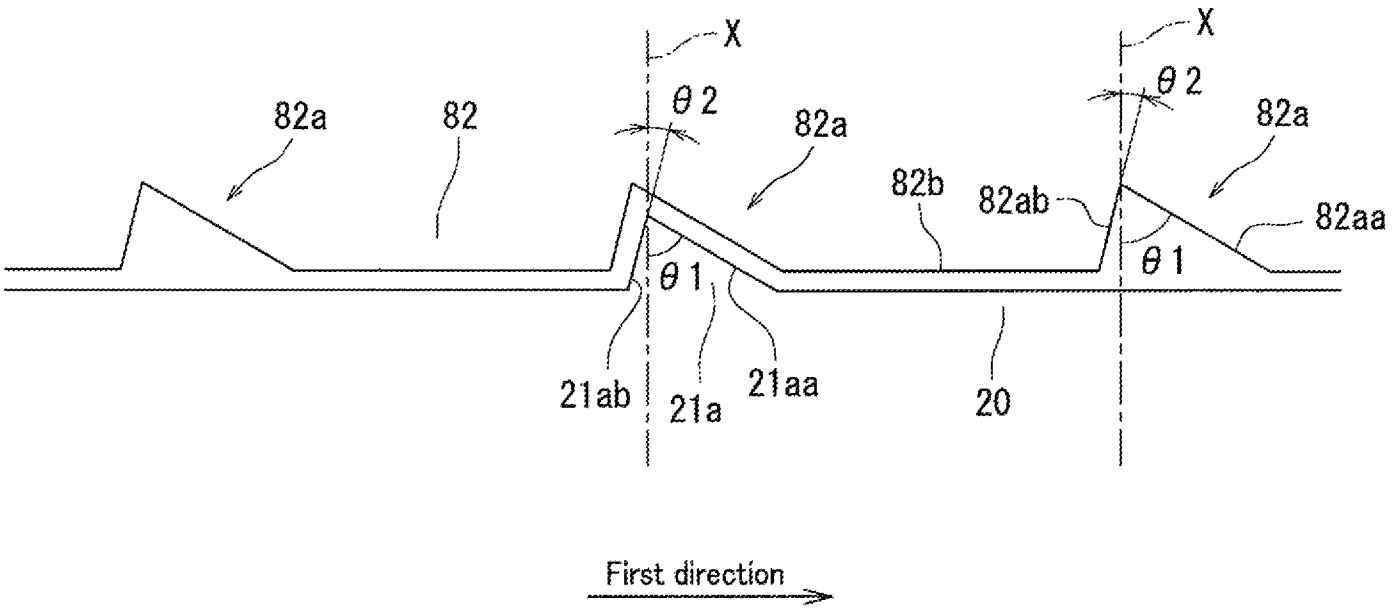
FIG. 6 is an enlarged developed view of an engaging portion and engaged portions according to a first embodiment of the present disclosure.

With reference to FIG. 6, the following describes an engaging portion 21 and engaged portions 82*a* according to a first embodiment. FIG. 6 is an enlarged developed view of the engaging portion 21*a* and the engaged portions 82*a* according to the first embodiment. The engaging portion 21*a* is provided in the paper feed cassette 20 and engages the size detection dial 80 to the paper feed cassette 20 at a predetermined angular intervals. The engaged portions 82*a* are provided in the size detection dial 80, and one of the engaged portions 82*a* is engaged by the engaging portion 21*a*. Each of the engaged portions 82*a* is structured to release engagement with the engaging portion 21*a* in response to a rational force equal to or greater than a predetermined value applied to the size detection dial 80, as specifically described below.

Each of the engaged portions 82*a* is a V-shaped notch and has a first edge 82*aa* and a second edge 82*ab* defining the V-shaped notch. The angle formed by the first edge 82*aa* relative to the rotation axis X is $\theta 1$ (where $0° < \theta 1$), and the angle formed by the second edge 82*ab* relative to the rotation axis X is $\theta 2$ (where $0° < \theta 2 < \theta 1$). The angle $\theta 1$ is appropriately determined in consideration of operability and tactile click feedback provided to the user.

Each of the engaged portions 82*a* can be engaged with and disengaged from the engaging portion 21*a* of the paper feed cassette 20. The engaging portion 21*a* is singly provided on the circumference of a circle opposing the engagement-engaging portions 82*a*. The engaging portion 21*a* is a V-shaped projection and has a third edge 21*aa* and a fourth edge 21*ab* defining the V-shaped projection. When one of the engaged portions 82*a* is engaged by the engaging portion 21*a*, the third edge 21*aa* of the engaging portion 21*a* confronts the first edge 82*aa* of the engaged portion 82*a* being engaged and the fourth edge 21*ab* of the engaging portion 21*a* confronts the second edge 82*ab* of the engaged portion 82*a* being engaged. The angle formed by the third edge 21*aa* relative to the rotation axis X is $\theta 1$, and the angle formed by the fourth edge 21*ab* relative to the rotation axis X is $\theta 2$. With one of the engaged portions 82*a* being engaged by the engaging portion 21*a*, the size detection dial 80 is restrained from rotating.

In the state where one of the engaged portions 82*a* is engaged by the engaging portion 21*a*, when the user rotates the size detection dial 80 (see FIG. 5) in a direction reverse to the first direction shown in FIG. 6 (hereinafter, the reverse direction is referred to as a second direction), the first edge 82*aa* of the engaged portion 82*a* being engaged comes into contact against the third edge 21*aa* of the engaging portion 21*a*. When the user further rotates the size detection dial 80 in the second direction, a reaction force is exerted on the first edge 82*aa* of the engaged portion 82*a* by the third edge 21 as of the engaging portion 21*a* and consequently an upward force is applied to the size detection dial 80. As a result, the size detection dial 80 is moved upward along the inclined surface of the engaging portion 21*a* against the urging force of the spring. Once the engaged portion 82*a* passes over the engaging portion 21*a*, the engaged portion 82*a* is disengaged from the engaging portion 21*a*.

When the user further rotates the size detection dial 80 in the second direction, the lower edge 82*b* of the mount 82 rides on the engaging portion 21*a* and the size detection dial 80 rotates further with this state. Eventually, the rightmost engaged portion 82*a* shown in FIG. 6 reaches the position of the engaging portion 21*a* where the size detection dial 80 is moved downward by the action of the spring. As a result, the engaged portion 82*a* is engaged by the engaging portion 21*a*. Through cooperation of the engaged portions 82*a* and the engaging portion 21*a*, the size detection dial 80 is engaged with the paper feed cassette 20 at the predetermined angular intervals.

In the state where one of the engaged portions 82*a* is engaged by the engaging portion 21*a*, one of the size marks disposed on the circumferential surface of the mount 82 is visible through the observing window 22 (see FIG. 3) of the paper feed cassette 20. The user rotates the size detection dial 80 to place the size mark corresponding to the size of paper stored in the paper feed cassette 20 at a position visible through the observing window 22.

Then, when the user inserts the paper feed cassette 20 into the apparatus body 10, at least one of the size detection switches 92 is activated by being depressed by at least one of the pressure portions 81*a* of the dial portion 81 or all of the size detection switches 92 are left unactivated by not being depressed by any of the pressure portions 81*a* of the dial portion 81. The controller (not illustrated) of the image forming apparatus 1 identifies the size of paper based on the ON and OFF combination of the size detection switches 92.

In the case where the paper feed cassette 20 is inserted into the apparatus body 10, when at least one of the pressure portions 81*a* comes to depress at least one of the size detection switches 92, the size detection switch 92 being depressed applies a rotational force in the first direction to the size detection dial 80. As a result, the size detection dial 80 rotates in the first direction by a slight amount and the second edge 82*ab* of the engaged portion 82*a* being engaged by the engaging portion 21*a* comes into contact against the fourth edge 21*ab* of the engaging portion 21*a*. Note that the first direction coincides with the direction of rotational force applied to the size detection dial 80 via the pressure portion 81*a* by the size detection switch 92 when the paper feed cassette 20 is attached to the apparatus body 10.

The force necessary to rotate the size detection dial 80 in the first direction to release the engagement between the engaged portion 82*a* and the engaging portion 21*a* is greater than the force necessary to release the engagement between an engaged portion and an engaging portion in an image forming apparatus of a comparative example. Consequently, the image forming apparatus 1 according to the present embodiment can restrict unintentional rotation of the size detection dial 80 at the time of inserting the paper feed cassette 20 into the apparatus body 10, more reliably than the image forming apparatus according to the comparative example.

Figure 7:
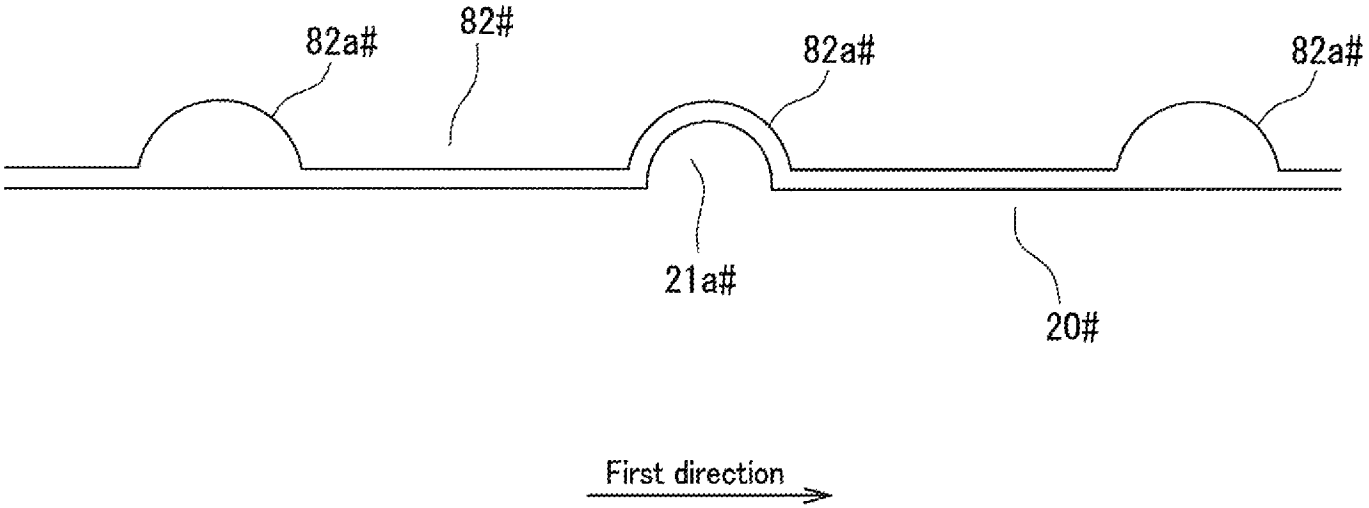
FIG. 7 is an enlarged developed view of an engaging portion and engaged portions according to a comparative example.

The reason therefore is described with reference to FIGS. 6 and 7. FIG. 7 is an enlarged developed view of an engaging portion 21*a*# and engaged portions 82*a*# according to the comparative example. As shown in FIG. 7, a mount 82# according to the comparative example is provided with the engaged portions 82*a*# each of which is a semi-circular notch, and a paper feed cassette 20# according to the comparative example is provided with the engaging portion 21*a*# which is a semi-circular projection. In this case, the rotational force in the first direction necessary for causing the engagement between one of the engaged portions 82*a*# and the engaging portion 21*a*# to be released is equal to that in the second direction. Therefore, when a size detection switch applies the rotational force in the first direction to a size detection dial, the engagement between the engaged portion 82*a*# and the engaging portion 21*a*# may be re-released.

According to the present embodiment, the rotational force in the first direction necessary for causing the engagement between the engaged portion 82*a* and the engaging portion 21*a* to be released is greater than the rotational force in the first direction necessary for causing engagement between the engaged portion 82*a*# and the engaging portion 21*a*# to be released in the comparative example shown in FIG. 7. More specifically, according to the present embodiment, the second edge 82*ab* of each of engaged portions 82*a* shown in FIG. 6 forms an angle within a range of 45° to 90° relative to the first direction, whereas the fourth edge 21*ab* of the engaging portion 21*a* shown in FIG. 6 forms, relative to the first direction, an angle that is substantially equal to the angle formed by the second edge 82*ab* relative to the first direction. That is, the rotational force necessary for the engaged portion 82*a* to pass over the engaging portion 21*a* in the first direction is greater than the rotational force necessary for the engaged portion 82*a*# shown in FIG. 7 to pass over the engaging portion 21*a*# in the first direction. In addition, the rotational force on the size detection dial 80 necessary for allowing the engaged portion 82*a* to pass over the engaging portion 21*a* in the first direction is greater than the rotational force applied by the size detection switches 92 to the size detection dial 80 in the first direction upon insertion of the paper feed cassette 20 into the apparatus body 10. This means that the image forming apparatus 1 according to the present embodiment can restrict unintentional release of the engagement between the engaged portion 82*a* and the engaging portion 21*a* upon insertion of the paper feed cassette 20 into the apparatus body 10, more reliably than the image forming apparatus according to the comparative example. The present embodiment is therefore effective to prevent errors in paper size detection. In response to rotation of the size detection dial 80 in the first direction, the second edge 82*ab* of one of the engaged portion 82*a* comes into contact against the fourth edge 21*ab* of the engaging portion 21*a* confronting the second edge 82*ab*.

According to the present embodiment, in addition, the rotational force in the second direction necessary for causing the engagement between the engaged portion 82*a* and the engaging portion 21*a* to be released is less than the rotational force in the second direction necessary for causing the engagement between the engaged portion 82*a*# and the engaging portion 21*a*# in the comparative example shown in FIG. 7. More specifically, according to the present embodiment, the first edge 82*aa* of each engaged portion 82*a* forms an angle of 45° or less relative to the second direction, whereas the third edge 21*aa* of the engaging portion 21*a* forms, relative to the second direction, an angle that is substantially equal to the angle formed by the first edge 82*aa* relative to the second direction. That is, the rotational force necessary for the engaged portion 82*a* to pass over the engaging portion 21*a* in the second direction is less than the rotational force necessary for the engaged portion 82*a*# shown in FIG. 7 to pass over the engaging portion 21*a*# in the second direction. The present embodiment therefore achieves to improve the operability of the size detection dial 80 as compared with the comparative example. In response to rotation of the size detection dial 80 in the second direction, the first edge 82*aa* of one of the engaged portions 82*a* comes into contact against the third edge 21*aa* of the engaging portion 21*a* confronting the first edge 82*aa*.

According to the present embodiment, in addition, the engagement of the engaged portion 82*a* by the engaging portion 21*a* can be released in response to rotation of the size detection dial 80 in the second direction. In addition, the engagement of the engaged portion 82*a* by the engaging portion 21*a* can also be released in response to rotation of the size detection dial 80 in the first direction. More specifically, the engagement between the engaged portion 82*a* and the engaging portion 21*a* can be released in response to rotation of the size detection dial 80 in the second direction. In addition, the engagement between the engaged portion 82*a* and the engaging portion 21*a* can also be released in response to rotation of the size detection dial 80 in the first direction. This is advantageous in the situation as follows. When the user rotates the size detection dial 80 in the second direction to place a desired size mark at a position visible through the observing window 22, the engaged portion 82*a* intended for engagement with the engaging portion 21*a* may pass over the engaging portion 21*a*. This results in that the engaged portion 82*a* located next to the intended one is engaged by the engaging portion 21*a*. The situation may be corrected by further rotating the size detection dial 80 in the second direction until the intended engaged portion 82*a* is engaged by the engaging portion 21*a*. However, this operation is laborious because the size detection dial 80 needs to be rotated through a large angle.

According to the present embodiment, the size detection dial 80 can be rotated in the first direction. Therefore, the engagement between the engaged portion 82*a* and the engaging portion 21*a* can be released in response to rotation of the size detection dial 80 in the first direction. When a wrong engaged portion 82*a* is placed in engaged by the engaging portion 21*a*, the user can rotate the size detection dial 80 in the first direction only through a relatively small rotation angle to bring an intended engaged portion 82*a* in engagement with the engaging portion 21*a*.

Figure 8:
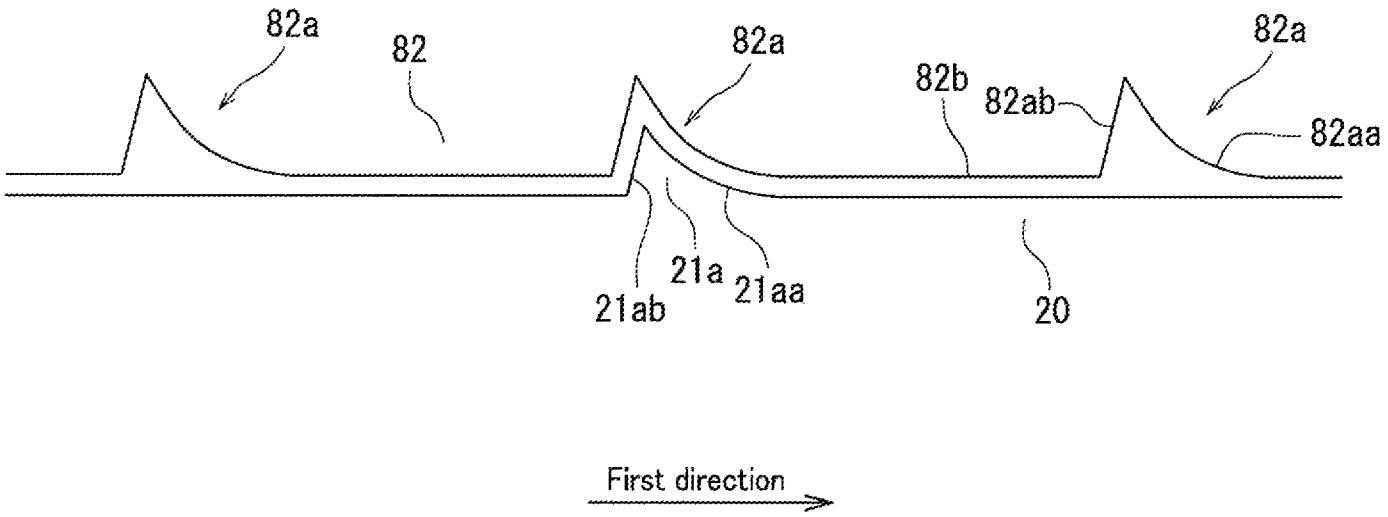
FIG. 8 is an enlarged developed view showing an engaging portion and engaged portions according to a second embodiment of the present disclosure.

The following now describes a second embodiment of the present disclosure. FIG. 8 is an enlarged developed view of an engaging portion 21*a* and engaged portions 82*a* according to the second embodiment. In the present embodiment, corresponding parts are denoted by the same reference signs as those used in the first embodiment and no overlapping explanation is given.

According to the present embodiment, each of the engaged portions 82*a* is a notch and has a first edge 82*aa* and a second edge 82*ab* defining the notch. The first edge 82*aa* is arcuately curved toward the engaging portion 21*a* at a position where the engaged portion 82*a* is in engagement with the engaging portion 21*a*, and the second edge 82*ab* is inclined relative to the first direction. The engaging portion 21*a* is a projection and has a third edge 21*aa* and a fourth edge 21*ab* defining the projection. The third edge 21*aa* of the engaging portion 21*a* confronting one of the first edges 82*aa* is arcuately curved so as to conform to the first edge 82*aa*. The fourth edge 21*ab* of the engaging portion 21*a* confronting one of the second edges 82*ab* is inclined relative to the first direction so as to conform to the second edge 82*ab*. Other than those described above, the structure of the present embodiment is identical to the first embodiment.

According to the present embodiment, the angle formed by the first edge 82*aa* of each engaged portion 82*a* relative to a lower edge 82*b* of a mount 82 changes to define a parabolic curve. Likewise, the angle formed by the third edge 21*aa* of the engaging portion 21*a* relative to the lower edge 82*b* of the mount 82 changes to define a parabolic curve. This configuration reduces the rotational force necessary for the user to apply for initiating rotation of the size detection dial 80 in the second direction in order to release the engagement between the engaged portion 82*a* and the engaging portion 21*a*, as compared with the rotational force required for the user to apply for rotating the size detection dial 80 in the first embodiment. That is, the second embodiment improves the operability as compared with the first embodiment. According to the present embodiment, in addition, the angle formed by the third edge 21*aa* of the engaging portion 21*a* relative to the lower edge 82*b* of the mount 82 is greater at a portion around the apex of the engaging portion 21*a* than that in the first embodiment. Therefore, when the engaged portion 82*a* passes over the engaging portion 21*a*, the user receives more tactile click feedback as compared with that received in the first embodiment. The present embodiment therefore improves the operability as compared with the first embodiment.

As has been described with reference to FIGS. 1-8, the embodiments are directed to the image forming apparatus 1 that detects the size of recording mediums stored in the paper feed cassette 20 automatically upon insertion of the paper feed cassette 20 to the apparatus body 10, while restricting errors in detection of the recording medium size without compromising the user operability.

Up to this point, the present disclosure has been described by way of the specific embodiments. However, the present disclosure is not limited to these embodiments and various alterations may be made within the scope not departing from the gist of the present disclosure.

For example, according to the embodiments, the engaged portions are provided in the rotary operating member and the engaging portion is provided in the paper feed cassette. Alternatively, however, one or more engaged portions may be provided in the paper feed cassette and one or more engaging portions may be provided in the rotary operating member.

Either: the engaging portion may be a notch and the engaged portions may be projections each having a shape conforming to the notch; or the engaged portions may be notches and the engaging portion may be a projection having a shape conforming to each of the notches. In addition, a single engaging portion and a plurality of engaged portions may be provided or a plurality of engaging portions and a single engaged portion may be provided.

According to the embodiments, the rotary operating member is provided with seven pressure portions. Alternatively, however, the rotary operating member may be provided with six or fewer pressure portions or eight or more pressure portions.

According to the embodiments, the apparatus body is provided with three size detection switches. Alternatively, however, the apparatus body may be provided with four or more size detection switches or two or less size detection switches.

The embodiments are directed to the cases where the present disclosure is applied to a printer. Alternatively, however, the present disclosure may be applied to image forming apparatuses (for example, multifunction peripherals) other than the printer.

The embodiments are directed to the cases where the recording medium is paper. Alternatively, however, the recording medium may be other than paper and an overhead projector (OHP) sheet.

In addition to those described above, various alterations may be made to the embodiments without departing from gist of the present disclosure.

What is claimed is:

1. An image forming apparatus comprising:

an apparatus body;

a paper feed cassette attachable to and detachable from the apparatus body;

a rotary operating member rotatably mounted to the paper feed cassette;

an engaging portion provided in the paper feed cassette and configured to engage the rotary operating member with the paper feed cassette at predetermined angular intervals;

a plurality of engaged portions provided in the rotary operating member, any one of the engaged portions being engaged by the engaging portion; and a size detection switch mounted to the apparatus body and configured to detect a size of a recording medium stored in the paper feed cassette, wherein the rotary operating member includes a pressure portion configured to activate the size detection switch, each of the engaged portions is configured to release engagement with the engaging portion in response to a rotational force equal to or greater than a predetermined value applied to the rotary operating member, a rotational force in a first direction necessary for causing the engagement to be released is greater than a rotational force in a second direction necessary for causing the engagement to be released, the second direction being reverse of the first direction, the plurality of engaged portions are disposed on a lower edge of the rotary operating member in a circumferential direction of the rotary operating member, the engaging portion is disposed below the rotary operating member and at a position on a circumference of a circle opposing the engaged portions, each of the engaged portions has an asymmetric profile in the circumferential direction, the engaging portion has an asymmetric profile in the circumferential direction, either the engaging portion is a notch and the engaged portions are projections each having a shape conforming to the notch or the engaged portions are notches and the engaging portion is a projection having a shape conforming to each of the notches, the notch is a triangular notch, each of the engaged portions has a first edge and a second edge defining the triangular notch, the projection is a triangular projection, the engaging portion has a third edge and a fourth edge defining the triangular projection, an angle formed by the first edge of each of the engaged portions relative to a rotation axis of the rotary operating member is θ1, and an angle formed by the second edge of each of the engaged portions relative to the rotation axis is θ2, where θ1>θ2>0° is satisfied, an angle formed by the third edge of the engaging portion confronting one of the first edges relative to the rotation axis is θ1, and an angle formed by the fourth edge of the engaging portion confronting one of the second edges relative to the rotation axis is θ2, and in response to rotation of the rotary operating member in the second direction, the first edge of one of the engaged portions comes into contact against the third edge of the engaging portion.

2. An image forming apparatus according to claim 1, wherein the engaging portion and each of the engaged portions are configured to release the engagement of the engaged portion by the engaging portion in response to rotation of the rotary operating member in the second direction.

3. An image forming apparatus according to claim 2, wherein the engaging portion and each of the engaged portions are configured to release the engagement of the engaged portion by the engaging portion in response to rotation of the rotary operating member in the first direction.

4. An image forming apparatus according to claim 1, wherein the first direction coincides with a direction of a rotational force applied to the rotary operating member via the pressure portion by the size detection switch when the paper feed cassette is attached to the apparatus body.

5. An image forming apparatus according to claim 1, wherein the plurality of engaged portions are disposed at equally spaced intervals.

6. An image forming apparatus comprising:

an apparatus body;

a paper feed cassette attachable to and detachable from the apparatus body;

a rotary operating member rotatable mounted to the paper feed cassette;

an engaging portion provided in the paper feed cassette and configured to engage the rotary operating member with the paper feed cassette at predetermined angular intervals;

a plurality of engaged portions provided in the rotary operating member, any one of the engaged portions being engaged by the engaging portion; and a size detection switch mounted to the apparatus body and configured to detect a size of a recording medium stored in the paper feed cassette, wherein the rotary operating member includes a pressure portion configured to activate the size detection switch, each of the engaged portions is configured to release engagement with the engaging portion in response to a rotational force equal to or greater than a predetermined value applied to the rotary operating member, a rotational force in a first direction necessary for causing the engagement to be released is greater than a rotational force in a second direction necessary for causing the engagement to be released, the second direction being reverse of the first direction, the plurality of engaged portions are disposed on a lower edge of the rotary operating member in a circumferential direction of the rotary operating member, the engaging portion is disposed below the rotary operating member and at a position on a circumference of a circle opposing the engaged portions, each of the engaged portions has an asymmetric profile in the circumferential direction, the engaging portion has an asymmetric profile in the circumferential direction, either the engaging portion is a notch and the engaged portions are projections each having a shape conforming to the notch or the engaged portions are notches and the engaging portion is a projection having a shape conforming to each of the notches, each of the engaged portions has a first edge and a second edge defining the notch, the first edge is arcuately curved toward the engaging portion at a position where the engaged portion is in engagement with the engaging portion, and the second edge is inclined relative to the first direction, and the engaging portion has a third edge and a fourth edge defining the projection, the third edge confronting one of the first edges is arcuately curved so as to conform to the first edge, and the fourth edge confronting one of the second edges is inclined relative to the first direction so as to conform to the second edge.

7. An image forming apparatus according to claim 6, wherein the plurality of engaged portions are disposed at equally spaced intervals.

8. An image forming apparatus according to claim 6, wherein the engaging portion and each of the engaged portions are configured to release the engagement of the engaged portion by the engaging portion in response to rotation of the rotary operating member in the second direction.

9. An image forming apparatus according to claim 8, wherein the engaging portion and each of the engaged portions are configured to release the engagement of the engaged portion by the engaging portion in response to rotation of the rotary operating member in the first direction.

10. An image forming apparatus according to claim 6, wherein the first direction coincides with a direction of a rotational force applied to the rotary operating member via the pressure portion by the size detection switch when the paper feed cassette is attached to the apparatus body.

11. An image forming apparatus comprising:

an apparatus body;

a paper feed cassette attachable to and detachable from the apparatus body;

a rotary operating member rotatably mounted to the paper feed cassette;

an engaging portion provided in the paper feed cassette and configured to engage the rotary operating member with the paper feed cassette at predetermined angular intervals;

a plurality of engaged portions provided in the rotary operating member, any one of the engaged portions being engaged by the engaging portion; and a size detection switch mounted to the apparatus body and configured to detect a size of a recording medium stored in the paper feed cassette, wherein the rotary operating member includes a pressure portion configured to activate the size detection switch, each of the engaged portions is configured to release engagement with the engaging portion in response to a rotational force equal to or greater than a predetermined value applied to the rotary operating member, a rotational force in a first direction necessary for causing the engagement to be released is greater than a rotational force in a second direction necessary for causing the engagement to be released, the second direction being reverse of the first direction, the plurality of engaged portions are disposed on a lower edge of the rotary operating member in a circumferential direction of the rotary operating member, the engaging portion is disposed below the rotary operating member and at a position on a circumference of a circle opposing the engaged portions, each of the engaged portions has an asymmetric profile in the circumferential direction, the engaging portion has an asymmetric profile in the circumferential direction, either the engaging portion is a notch and the engaged portions are projections each having a shape conforming to the notch or the engaged portions are notches and the engaging portion is a projection having a shape conforming to each of the notches, the notch is a triangular notch, each of the engaged portions has a first edge and a second edge defining the triangular notch, the projection is a triangular projection, the engaging portion has a third edge and a fourth edge defining the triangular projection, the second edge of each of the engaged portions forms an angle within a range of 45° to 90° relative to the first direction, the fourth edge of the engaging portion confronting one of the second edges forms, relative to the first direction, an angle that is substantially equal to the angle formed by the second edge relative to the first direction, in response to rotation of the rotary operating member in the first direction, the second edge of one of the engaged portions comes into contact against the fourth edge of the engaging portion, the first edge of each of the engaged portions forms an angle of 45° or less relative to the second direction, the third edge of the engaging portion confronting one of the first edges forms, relative to the second direction, an angle that is substantially equal to the angle formed by the first edge relative to the second direction, and in response to rotation of the rotary operating member in the second direction, the first edge of one of the engaged portions comes into contact against the third edge of the engaging portion.

12. An image forming apparatus according to claim 11, wherein the plurality of engaged portions are disposed at equally spaced intervals.

13. An image forming apparatus according to claim 11, wherein the engaging portion and each of the engaged portions are configured to release the engagement of the engaged portion by the engaging portion in response to rotation of the rotary operating member in the second direction.

14. An image forming apparatus according to claim 13, wherein the engaging portion and each of the engaged portions are configured to release the engagement of the engaged portion by the engaging portion in response to rotation of the rotary operating member in the first direction.

15. An image forming apparatus according to claim 11, wherein the first direction coincides with a direction of a rotational force applied to the rotary operating member via the pressure portion by the size detection switch when the paper feed cassette is attached to the apparatus body.

* * * * *